United States Patent [19]

Riggs

[11] Patent Number: 4,638,577

[45] Date of Patent: Jan. 27, 1987

[54] SHOE WITH ANGULAR SLOTTED MIDSOLE

[76] Inventor: Donnie E. Riggs, P.O. Box 2409, Carson City, Nev. 89702

[21] Appl. No.: 736,099

[22] Filed: May 20, 1985

[51] Int. Cl.[4] ..... A43B 13/04; A43B 13/18

[52] U.S. Cl. ..... 36/114; 36/28; 36/32 R

[58] Field of Search ..... 36/114, 25 R, 30 R, 36/31, 32 R, 30 A, 28, 29

[56] References Cited

U.S. PATENT DOCUMENTS

| | | | |
|---|---|---|---|
| 2,199,853 | 5/1940 | Joyce, Jr. | 36/28 |
| 2,527,414 | 10/1950 | Hallgren | 36/32 R |
| 2,547,480 | 4/1951 | McDaniel | 36/30 R |
| 2,985,971 | 5/1961 | Murawski | 36/29 |
| 3,079,708 | 3/1963 | Hack et al. | 36/28 |
| 3,087,261 | 4/1963 | Russell | 36/28 |
| 3,087,262 | 4/1963 | Russell | 36/28 |
| 4,359,830 | 11/1982 | Inohara | 36/29 |
| 4,438,573 | 3/1984 | McBarron | 36/29 |

FOREIGN PATENT DOCUMENTS

| | | | |
|---|---|---|---|
| 841035 | 5/1939 | France | 36/30 R |
| 1461743 | 12/1966 | France | 36/29 |
| 535171 | 4/1941 | United Kingdom | 36/30 R |

OTHER PUBLICATIONS

WO/8101234, May 1981, PCT, Vantilburg et al.

*Primary Examiner*—Henry S. Jaudon
*Assistant Examiner*—Steven N. Meyers
*Attorney, Agent, or Firm*—Gerald L. Moore

[57] ABSTRACT

An athletic shoe having an upper portion (15) fixed to a lower portion (16) comprising a midsole (21) and an attached wear surface (22). To provide both cushioning and stability to the foot the midsole includes slots or channels (25, 27) extending at an angle other than normal to the wear surface so as to provide a cushioning effect when forces are exerted through the shoe in one direction, as during the heel contact phase of running, and forming therebetween crossbeams 23 to provide stability and force transfer from the foot to the ground as required during the push-off phase of running.

13 Claims, 13 Drawing Figures

SHOE WITH ANGULAR SLOTTED MIDSOLE

FIELD OF THE INVENTION

This invention relates primarily to shoes and more particularly, to an improvement in the midsole of shoes to improve both the cushioning and the stabilizing effect on the feet.

BACKGROUND OF THE INVENTION

In most types of footwear, especially athletic shoes, the lower or underfoot portion of the shoe comprises a midsole which is directly attached to the shoe upper portion. A wear surface is fixed to the bottom of the midsole. The purpose of the wear surface is to resist wear as the ground is contacted.

The midsole is designed primarily to provide stability for the foot while attenuating shock. In running and walking, the foot makes initial contact with the ground surface on the lateral aspect of the rearfoot area. At initial contact, the foot and ankle sustain the greatest shock as the weight of the body is shifted to the heel of one foot. Immediately after initial contact, the lower limb experiences internal rotation and the foot pronates at the subtalar joint to initiate the midstance phase of the gait until the entire foot rests on the ground. At this time the lower limb experiences external rotation and the motion of the foot is supination. The final phase of the gait cycle is the propulsive phase during which the foot is supinating to provide a rigid lever for exerting the force of the leg on the ground surface to propel the body forward.

The footwear, in serving as the contact member between the foot and ground, ideally must first be a shock attenuator and stabilizer for the heel during the contact phase of the gait. Thereafter during the midstance phase the shock attenuation function continues but to a lesser degree while foot stabilizing increases in importance. During the propulsive phase the stability of the foot remains important with the shoe also now serving to transmit the propelling force from the foot to the ground surface. It can be seen that the shoe midsole ideally must be pliable during the contact and midstance phases but should be at least semi-rigid during the propulsion phase while always providing both lateral and medial stability to protect the ankle.

Present shoe midsoles have represneted a compromise design in an attempt to accommodate the various phases of running and walking. To reduce the shock of initial contact with the ground it is advantageous to provide a more pliable shoe midsole. However, the more pliable midsole provides less stability to the foot, that is, it allows the foot to roll over to one side or the other more easily, an action that can easily result in injury to the foot or ankle. Such injuries are even more frequent when running on uneven ground and solid or hard surfaces.

It is the purpose of the present invention to provide greater shock attenuation in a shoe while maintaining stability and foot control throughout the weight bearing phases of gait.

SUMMARY OF THE INVENTION

A shoe comprising an upper portion forming a cavity to receive the wearer's foot and a lower portion including a midsole fixed to the bottom of the upper portion and having a wear surface formed on the bottom side. The midsole includes a layer of resilient material having a discontinuous cross section forming a plurality of channels or discontinuities, unfilled or filled with other material, and extending in a general direction across the wearer's foot. The channels preferably extend at various angles other than normal to the wear surface so as to allow the midsole to compress when the wear surface contacts the ground surface and thereby provide a cushioning or shock absorption effect. Thereafter when the forces are applied in a direction perpendicular to these channels during the propulsive phase of the gait the channels provide rigidity in transferring the propelling forces from the leg to the ground. Between the channels the midsole material from crossbeams or trusses extending substantially normal to the shoe's major axis to provide medial and lateral stability to the foot.

DESCRIPTION OF THE INVENTION

Figure 1:
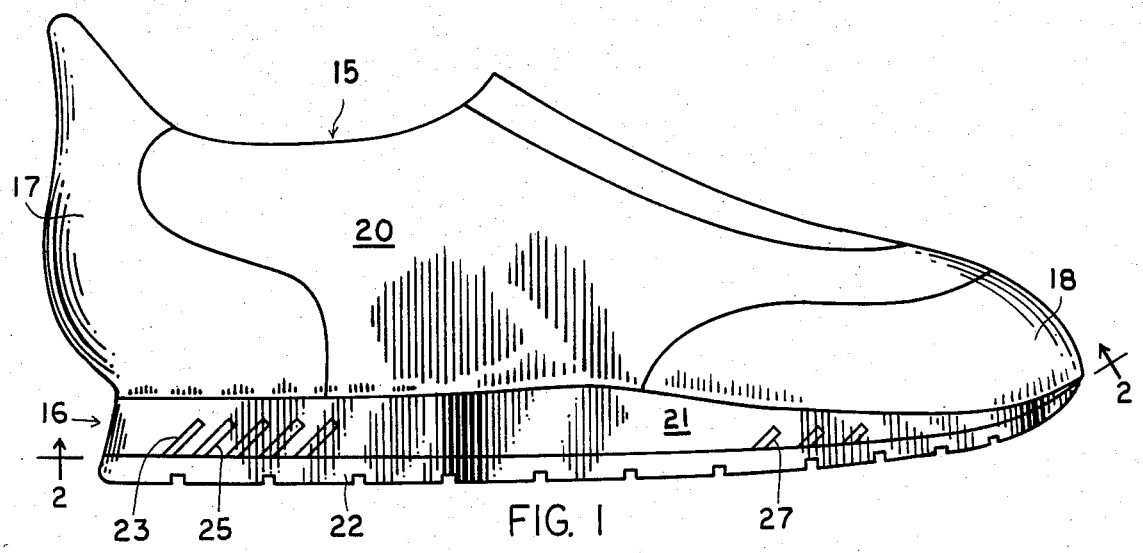
FIG. 1 is a side view of a typical athletic shoe incorporating the subject invention.
Figure 2:
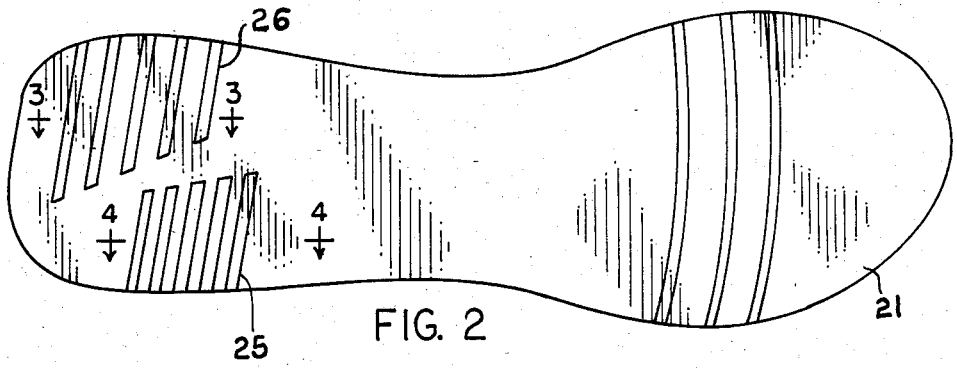
FIG. 2 is a view of the bottom of the midsole of the shoe of FIG. 1 taken along the line 2—2.

In FIG. 1 is shown typical footwear in which the subject invention can be incorporated. Shown is an athletic shoe 14 having an upper portion 15 and a lower portion 16. Normally the upper portion is formed of leather, nylon, or a combination thereof with lacing or other type fasteners (not shown) to enclose the foot of the wearer. The upper portion includes a heel portion 17, a toe portion 18, and a center or shank portion 20 to support the arch and ball areas of the foot. The upper portion extends downward to a midsole 21 and a wear surface 22 which contacts the ground. The heel portion includes a heel counter 24 formed to enclose and support the heel. Usually such a shoe is fixed together by stitching and gluing.

The midsole 21 can form the wear surface but usually has fixed thereto a wear surface, by gluing or injection molding. The midsole forms the footbed to cradle the foot, and in particular the heel, and to cushion the foot as it is set down on the running surface. To compensate for the impact of the foot on the running surface a thick pliable midsole would be preferred, however a second purpose for the midsole is to support and provide stability to the foot during the resupination push-off stages of the running foot as previously discussed. Usually a more pliable or softer midsole will not provide satisfactory lateral and medial for the foot.

In accordance with the primary feature of the subject invention, the midsole is made of a pliable material and includes channels or discontinuities having sides generally extending at angles other than perpendicular to the wear surface so as to vary the effective pliability in the various sections of the midsole by forming a discontinuous cross section that reacts with more or less compensation of forces from differing directions. Between these channels the midsole material forms crossbeams to maintain the necessary lateral and medial stability. As shown in FIGS. 1–4, the heel area of the midsole includes a plurality of varied angular first slots 25 positioned under the heel counter to allow a greater compression of the midsole and to create a cushioning effect while the included crossbeams 23 therebetween provide stability during the varus foot impact stage of a running and walking gate. These channels extend generally from the shoe upper portion to the wear surface across the thickness of the midsole. By angling these channels under the outer side of the foot in the forward direction, the voids in the material in the form of channels allow for increased directional compression to provide increased comfort and protection. The midsole then reduces forces on the foot by this cushioning and control effect depending on the direction the forces are exerted usually in the forward and perpendicular directions. Such forces result as foot and shoe interface with the running surface. The number of channels and spacing of the channels are proportional to the desired shock attenuation and control desired. The portion of the shoe first striking the surface is the lateral position heel slots 25.

Figure 3:
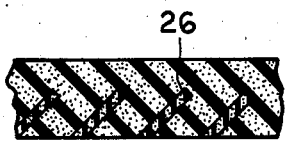
FIG. 3 is a view along the line 3—3 of FIG. 2.
Figure 4:
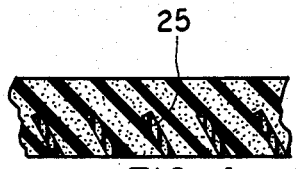
FIG. 4 is a view along the line 4—4 of FIG. 2.

After the initial contac phase of gait, whether during running or walking, the heel is rotated inwardly onto the inner aspect of the heel area and thrust forward with a weight shift to the area of the second slots 26 positioned more under the inner side of the heel. These slots as shown in FIG. 3, slant in the rearward direction opposite from the slots 25 so as to aid the controlling effect as the forces are shifted to this area of the heel. The angles and the length of the channels are reduced toward the front of the shoe where cushioning is less important and stability is paramount. However throughout the shoe the crossbeam construction of the midsole provides medial and lateral stability for the foot even though the pliability of the midsole to forces resulting from the running action is increased and varied.

With the channels being increased or decreased in angle, the pliability of the midsole is affected depending on the direction in which the shearing and compression forces are exerted on the midsole. A force directed perpendicular to the slots will encounter a more pliable midsole than forces acting more parallel to the slots because the channels in the midsole allow the midsole to compress in a domino or layered fashion. Thus, by varying the angles of the channels within the midsole at an attitude angled away from the perpendicular to the wear surface, the midsole is provided with variable and controllable pliabilities compatible with the various phases of gait. Additionally, the channels 27 under the ball of the foot allow flexibility and compression of the midsole as the foot is set down on the surface; but as push-off is initiated, the force is in a direction more parallel to the plane of the channels thus resulting in a less compressive midsole and allowing the crossbeam structure to better transmit the force from the foot to the running surface. The invention thereby compensates the pliability of the midsole depending on the direction in which the forces are applied to the foot and ground. It should be recognized that the channel can be filled with material of varying densities and still function in the manner described.

Figure 5:
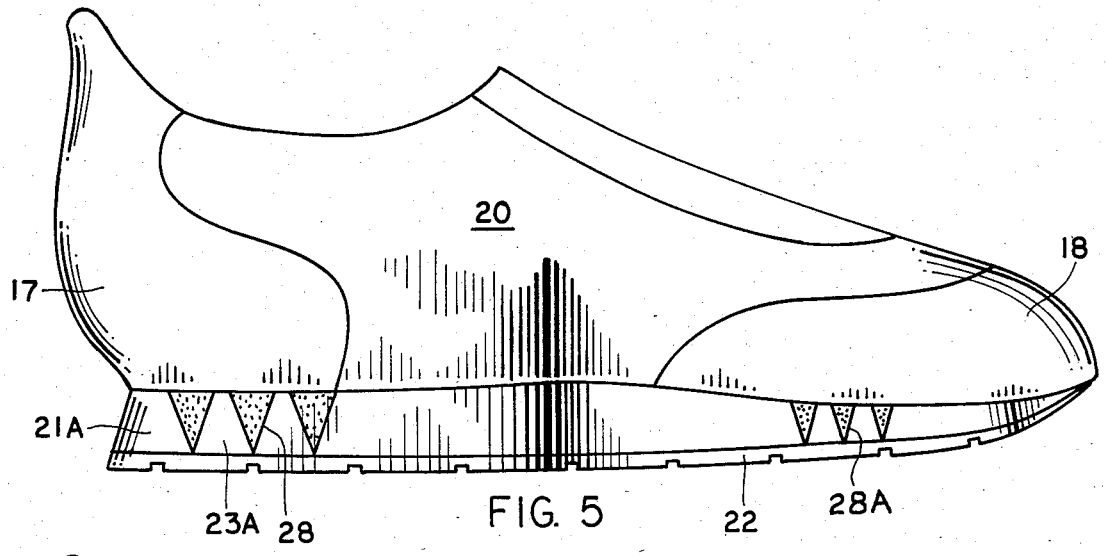

In FIG. 5 is shown yet another embodiment of the invention wherein a plurality of V cross-section slots 28 are formed in the midsole of an athletic shoe similar to that described in FIG. 1. Herein the midsole 21A includes a plurality of multiple V cross-section channels extending across the width of the heel. These V shaped channels are comprised of varied density resilient material so as to render that area more stable or pliable. As the heel is set down the compression forces tend to be transmitted from the foot through the midsole to the ground and because more of the pliable material extends directly from the foot to the ground; the midsole attenuates forces more readily for improved cushoning of the heel. The crossbeams 23A still maintain both lateral and medial stability of the foot.

Figure 6:
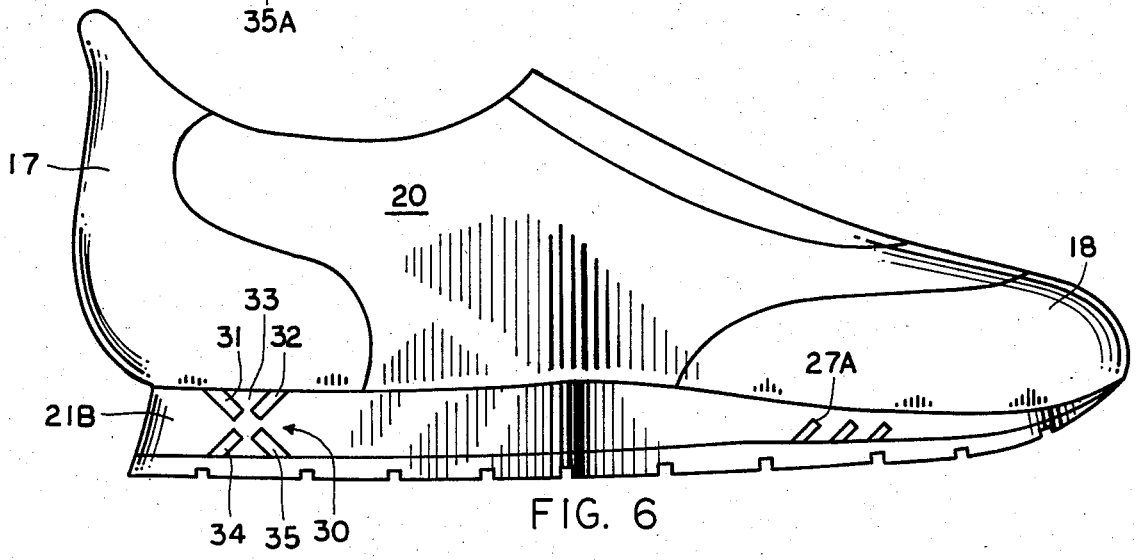

In FIG. 6 is shown yet another embodiment of the invention including a shoe as described heretofore incorporating a midsole 21B having a plurality of channels 30 positioned beneath the heel portion 17 of the shoe. In this embodiment a pair of slots 31 and 32 are angled in opposite directions and extend from the heel bed down to the mid area of the midsole while channels 34 and 35 extend in an inverted V configuration up from the wear surface of the shoe. Cross beams 33 remain between the slots and extend across the shoe. These channels are discontinuous in the direction of the plane of the channels which extend toward the upper portion of the shoe. As explained before, the channeled midsole will compress more easily when exposed to forces extending generally normal to the channels along the longitudinal axis of the shoe. The channels create a reduction of shear force normally exerted by the midsole material. Thus, the cross channels as shown in FIG. 6 will allow attenuation of shock while counteracting the longitudinal directed forces to create stability during the propulsive phase of the body. In this manner, the foot is cushioned yet the shoe remains sufficiently sturdy to maintain stability of the foot during the contact and propulsion stages of running.

Figure 7:
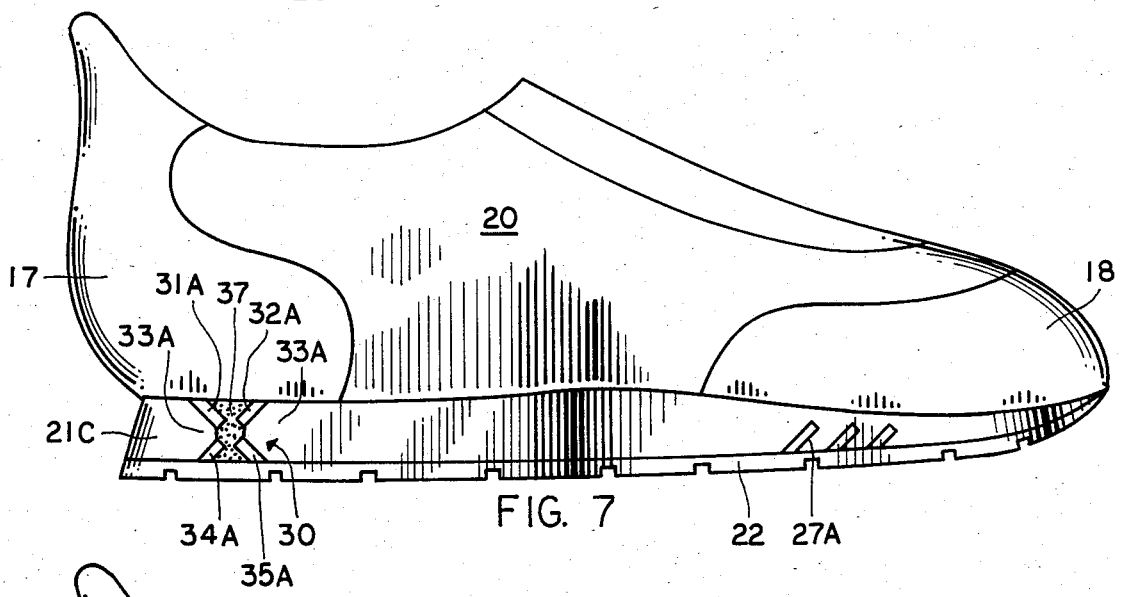

In FIG. 7 the slots 31A, 32A, 34A, and 35A are provided in the midsole 21C, however, in contrast to the embodiment of FIG. 6, the area between the adjacent slots is removed and a material 37 substituted. This substantial material is of a varied density and therefore will permit greater attenuation of forces in the midsole of the heel area while allowing for the normal stiffness of the midsole in other parts 33A of the shoe for greater control. The midsole configuration functions much in the same manner as that described in FIG. 6 with the controlled cushioning in the heel area. There is also shown the channels 27A which function as the channels 27 do in FIG. 1.

Figure 8:
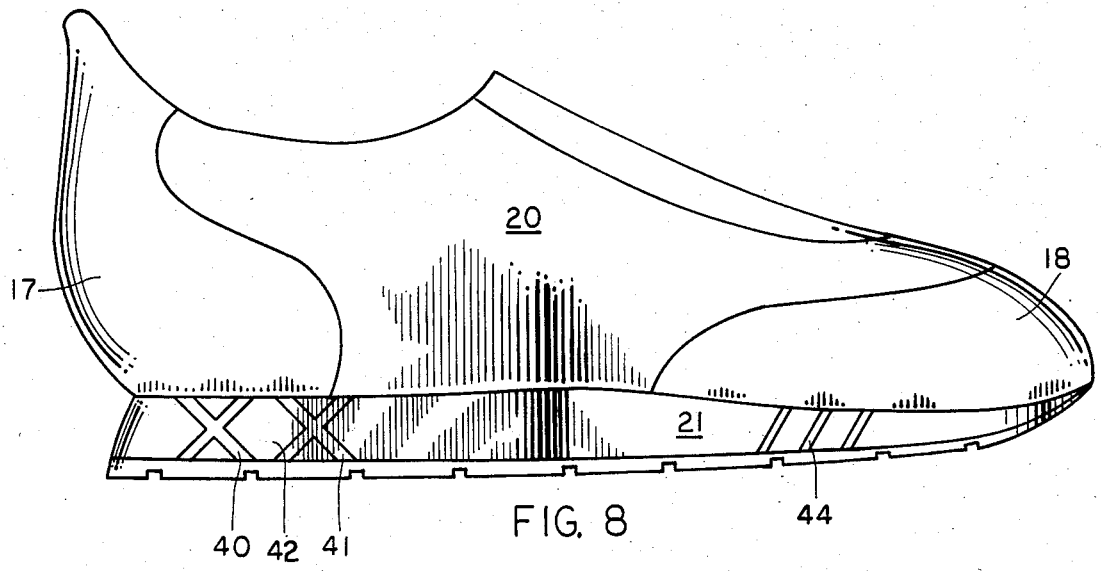

In FIG. 8 is shown yet another embodiment of the invention in which the channels are much like those of FIG. 6 except they are continuous in the plane of the channel. Also the "X" cross-sectioned channel combination is paired as configurations 40 and 41 and are filled with materials of differing pliability with the pliable material being in the channel configuration 40 to dissipate the forces caused when the heel area has initial contact with the running or walking surface. In this manner the strut configuration 42 extending across the shoe is substantially unaffected while the ability of the heel area to absorb or dissipate shock is enhanced. Thus the stability of the shoe remains intact while the shock absorption capabilities are enhanced. This embodiment also incorporates the channels 44 in the forward portion of the midsole, which channels function generally in the same manner as channels 27A previously described.

Figure 9:
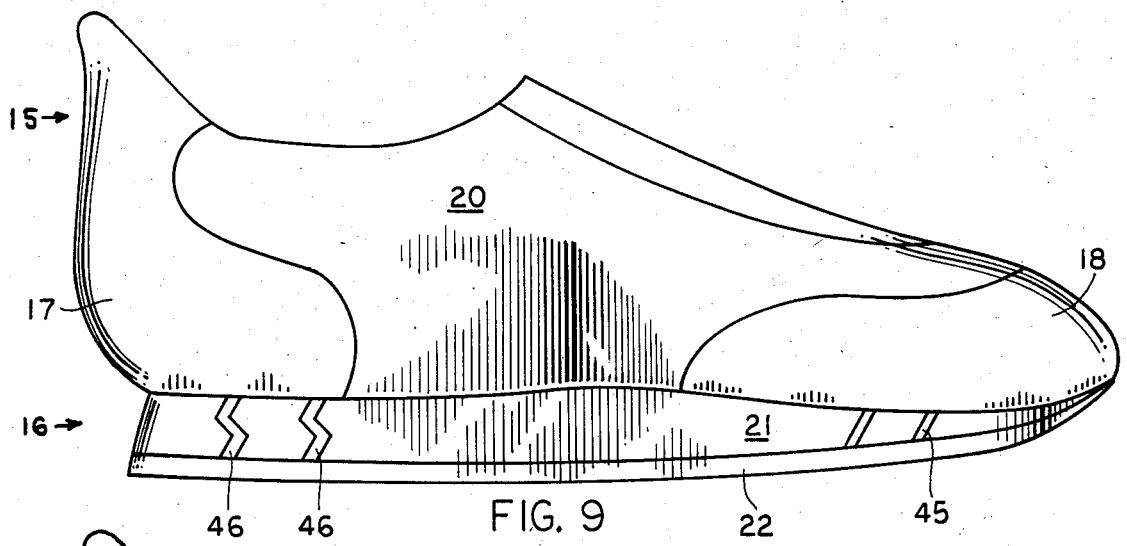
Figure 10:
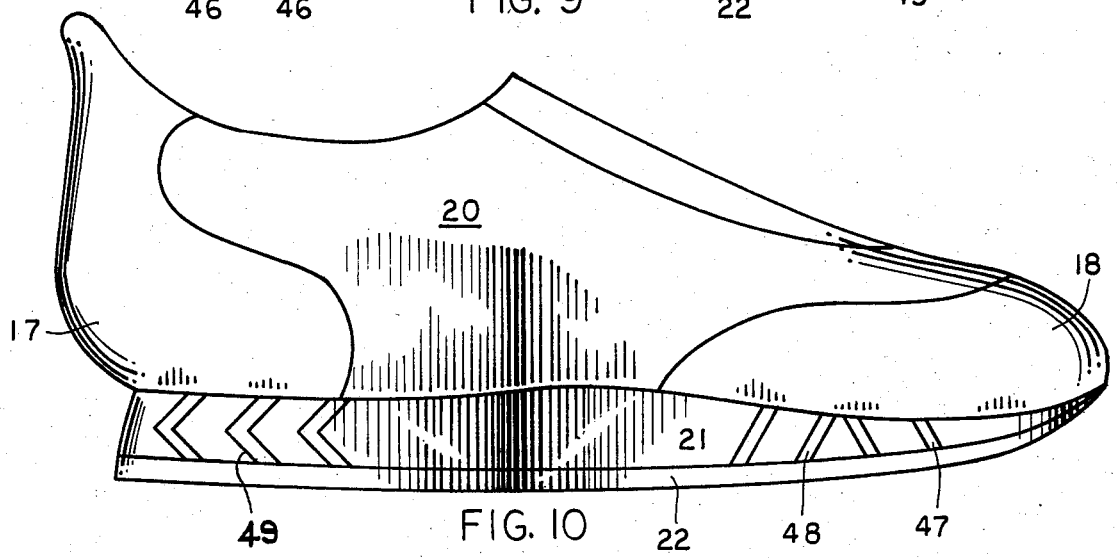

In FIGS. 9 and 10 the shoes 20 having parts similar to those already described, namely a heel portion 17, a toe protion 18 and a shank protion 20 supported by a midsole 21 and a wear surface 22. In FIG. 9 the midsole 21 includes the forwardly inclined channels 45 under the toe portion, which channels function in the manner previously described for similar embodiments.

In the heel portion of the midsole of FIG. 9, channels 46 are provided which are of a zig-zag cross-section. These channels function in the manner as those previously described in allowing compression of the midsole in some direction or directions and resisting compression more in other directions of force exerted depending on the density of the channel material used.

The midsole of FIG. 10 includes oppositely slanted channels 47 and 48 in the toe portion and the "chevron" cross-sectioned channels 49 in the heel portion to control compression, dissipate shock between the foot and ground, and reduce the forces of walking and running.

Figure 11:
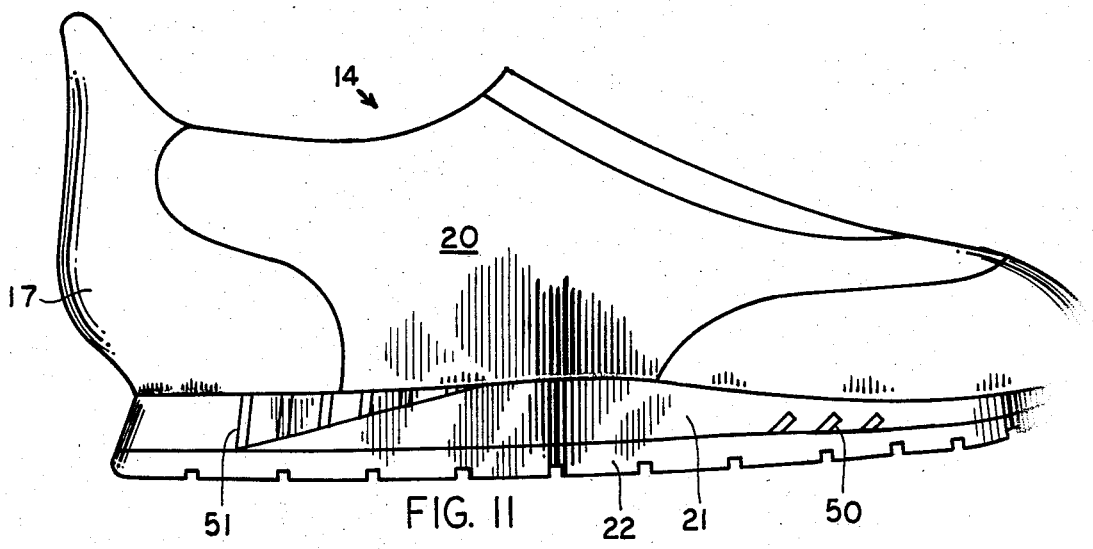
FIGS. 5 through 12 are side views of shoes incorporating other embodiments of the subject invention.

In FIG. 11 the shoe 14 includes the standard parts previously described. The midsole 21 includes forwardly slanted channels 50 in the toe portion. In the heel and shank areas of the midsole the channels 51 are of a controlled depth that diminishes as the slots are closer to the shank area. The slots also extend downward from the upper portion 15 of the shoe. In this manner the pliability of the midsole is varied not only with respect to the direction of the forces exerted on the midsole, but along the longitudinal axis of the shoe.

Figure 12:
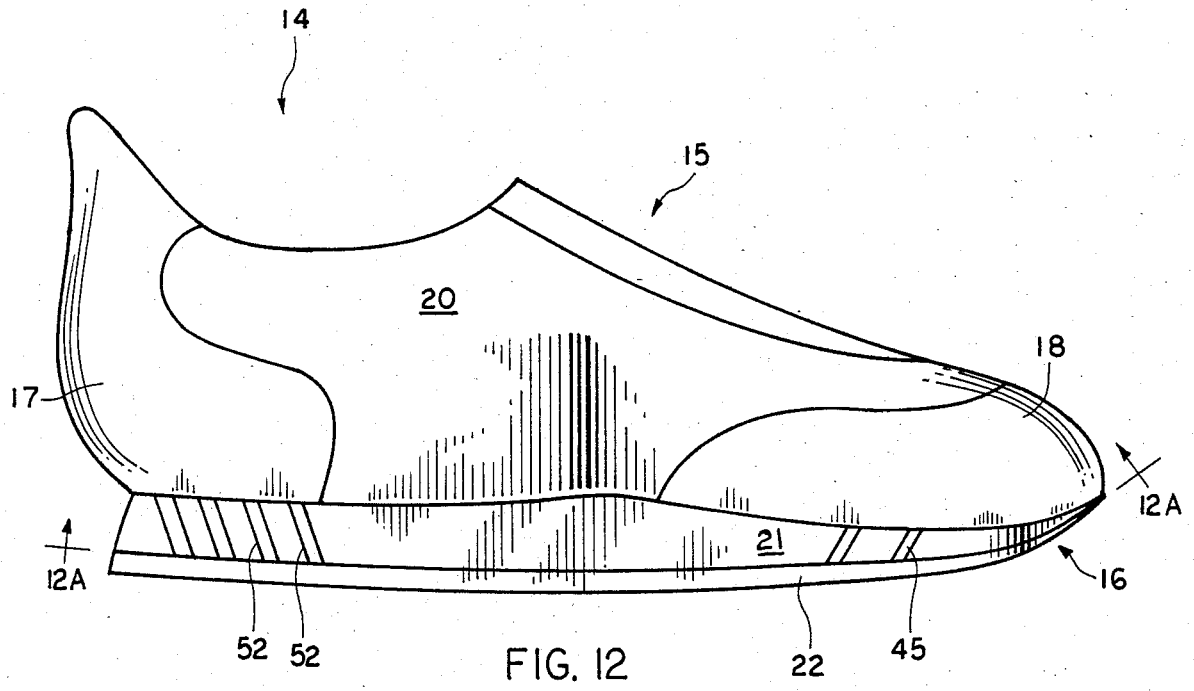
Figure 12A:
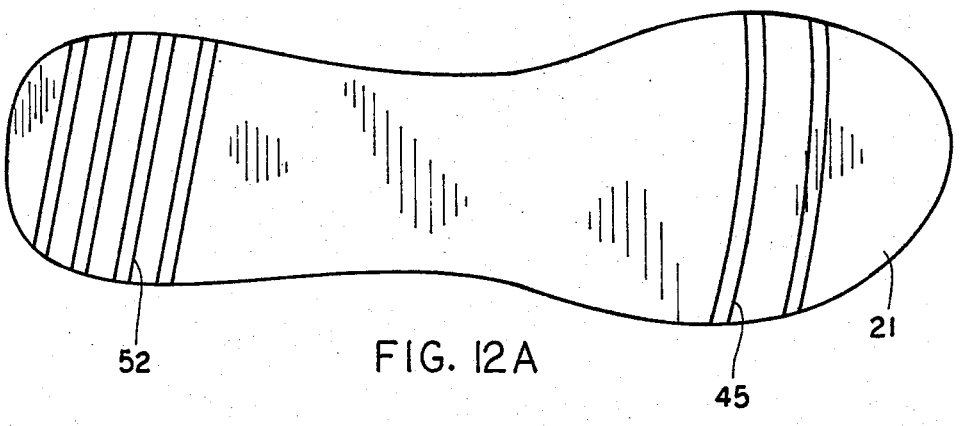
FIG. 12A is a view taken along the line 12A—12A of FIG. 12.

The shoe of FIG. 12 includes the standard components already described with the midsole including the rearwardly tilted channels 52 in the heel portion to attenuate shock as the heel and ground interact. Additionally, the toe portion of the midsole includes the forwardly slanted slots 45 previously described. These slots extend completely across the midsole to form continuous crossbeams or trusses for lateral and medial support of the foot.

I claim:

1. An athletic shoe comprising:

an upper portion forming a cavity to receive the wearer's foot and having heel and toe areas, and a lower portion to provide stability and cushioning to the wearer's foot, said lower portion comprising:

a midsole fixed to the upper portion and being formed at least in part of a first material, a wear surface formed on the bottom of the midsole to contact the ground, said midsole including a plurality of channels extending generally crosswise of the shoe and in the direction from shoe upper portion toward said wear surface to allow the midsole to compress and cushion the foot as the wearer's weight is exerted on said midsole and to form therebetween crossbeams to provide stability and transmit forces between the foot and the ground;

at least some of said channels in the midsole adjacent the heel area of said upper portion extending at one angle other than perpendicular to the wear surface and thereby being configured to absorb the shock of the shoe contacting the ground and at least some of said channels adjacent the toe area of the upper portion extending at a different angle from that of the channels adjacent the heel area and thereby being configured to provide rigidity to transfer force from the wearer's foot to the ground.

2. An athletic shoe as defined in claim 1 wherein said channels are formed with sides extending at an angle other than normal to said wear surface.

3. An athletic shoe as defined in claim 1 wherein said channels have sides extending non-parallel to each other.

4. An athletic shoe as defined in claim 1 wherein said channels are discontinuous across the thickness of said midsole.

5. An athletic shoe as defined in claim 1 wherein the midsole area between said channels is filled with a second material differing from said first material of the midsole.

6. An athletic shoe as defined in claim 5 wherein the second material between said channels is more pliable than the first material of the midsole.

7. An athleic shoe as defined in claim 5 wherein the channels adjacent the heel and toe areas of the upper portion are filled with different materials to absorb shock and transfer force respectively.

8. An athletic shoe as defined in claim 1 wherein the channels adjacent the heel and toe areas of the upper portion extend at different angles to the wear surface to absorb shock and transfer force respectively.

9. An athletic shoe comprising:

an upper portion comprising:

an upper portion having first and second sides forming a cavity to receive the wearer's foot and having heel and toe areas, and a lower portion to provide stability and cushoning to the wearer's foot, said lower portion comprising:

a midsole fixed to the upper portion and being formed at least in part of a first material, a wear surface formed on the bottom of the midsole to contact the ground, said midsole including a plurality of channels extending generally crosswise of shoe and in the direction from shoe upper portion toward said wear surface to allow the midsole to compress and cushion the foot as the wearer's weight is exerted on said midsole and to form therebetween crossbeams to provide stability and transmit forces between the foot and the ground;

said channels being formed with sides extending at an angle other than normal to said wear surface with said channels beneath the heel area of said upper portion extending at one angle to the wear surface adjacent said first side of the shoe and at a different angle to the wear surface adjacent the second side of the shoe.

10. An athletic shoe comprising:

an upper portion forming a cavity to receive the wearer's foot and having heel and toe areas, and a lower portion to provide stability and cushioning to the wearer's foot, said lower portion having inner and outer edges and comprising:

a midsole fixed to the upper portion and being made of a first material, a wear surface formed on the bottom of said midsole to contact the ground, said midsole including a plurality of first channels extending laterally from the outer edge and across the midsole and positioned beneath the heel area of the upper portion, said channels having spaced side walls extending at an angle other than perpendicular to the wear portion and extending forward from the wear surface so as to allow the midsole to compress beneath the heel area during initial contact between the shoe and ground to cushion the foot while forming between said channels a plurality of crossbeams serving to maintain the lateral stability of the shoe said first channels extending only partially across said midsole; and said midsole including a plurality of second channels extending from the inner edge of the shoe and beneath the heel area of the upper portion, said second channels having spaced side walls extending at an angle other than normal to said wear surface and extending rearward from the wear surface.

11. An athletic shoe as defined in claim 10 wherein said midsole also includes a plurality of third channels extending laterally across the midsole beneath the toe area of the upper portion.

12. An athleic shoe comprising:

an upper portion forming a cavity to receive the wearer's foot and having heel and toe areas, and a lower portion to provide stability and cushioning to the wearer's foot, said lower portion comprising:

a midsole fixed to the upper portion and being formed at least in part of a first material, a wear surface formed on the bottom of the midsole to contact the ground, said midsole including a plurality of channels extending generally crosswise of the shoe and in the direction from shoe upper portion toward said wear surface to allow the midsole to compress and cushion the foot as the wearer's weight is exerted on said midsole and to form therebetween crossbeams to provide stability and transmit forces between the foot and the ground;

at least some of said channels in said midsole having both walls non-planar with at least a portion thereof extending at an angle other than perpendicular to the wear surface thereby to absorb the shock of the shoe contacting the ground during walking and running.

13. An athletic shoe as defined in claim 12 wherein said channels extend completely from said upper portion to said wear surface.

* * * * *